US007922556B2

(12) United States Patent
Schreff et al.

(10) Patent No.: US 7,922,556 B2
(45) Date of Patent: Apr. 12, 2011

(54) INTERLOCKING CROSSBAR DEVICE AND SYSTEM

(75) Inventors: David J Schreff, Cos Cob, CT (US); Donna J Lindsay, Huddleston, VA (US); Julian Lindsay, Bedford, VA (US)

(73) Assignee: Claw L.L.C., Cos Cob, CT (US)

( * ) Notice: Subject to any disclaimer, the term of this patent is extended or adjusted under 35 U.S.C. 154(b) by 129 days.

(21) Appl. No.: 12/273,620

(22) Filed: Nov. 19, 2008

(65) Prior Publication Data

US 2009/0137184 A1 May 28, 2009

Related U.S. Application Data

(60) Provisional application No. 60/989,934, filed on Nov. 25, 2007.

(51) Int. Cl.
*A63H 17/00* (2006.01)
*A63F 9/12* (2006.01)

(52) U.S. Cl. ..... 446/93; 446/94; 273/156; 273/157 R

(58) Field of Classification Search ..... 446/93, 446/94, 95, 117, 118, 122, 124, 127, 128; 273/112, 153, 155, 156, 157 R
See application file for complete search history.

(56) References Cited

U.S. PATENT DOCUMENTS

| | | | | |
|---|---|---|---|---|
| 1,845,201 | A | 2/1932 | Shepard | |
| 2,493,697 | A * | 1/1950 | Raczkowski | 273/156 |
| 2,617,654 | A | 11/1952 | Nolan et al. | |
| 2,725,234 | A * | 11/1955 | Coble et al. | 273/157 R |
| 3,473,257 | A * | 10/1969 | Gambino | 446/101 |
| 3,611,618 | A | 10/1971 | Steiner | |
| 3,720,008 | A * | 3/1973 | Hutar | 434/430 |
| 3,986,293 | A | 10/1976 | Rieur | |
| 4,680,018 | A | 7/1987 | Ohno | |
| 4,744,780 | A | 5/1988 | Volpe | |
| 4,758,195 | A * | 7/1988 | Walsh | 446/85 |
| 4,804,349 | A | 2/1989 | Loscalzo et al. | |
| 4,813,903 | A | 3/1989 | Furukawa et al. | |
| 4,947,527 | A | 8/1990 | Hennig | |
| 4,986,789 | A | 1/1991 | Hang | |
| 4,993,983 | A | 2/1991 | Kurita et al. | |
| 5,022,885 | A | 6/1991 | Lyman | |
| 5,046,981 | A | 9/1991 | Roddy | |
| 5,396,713 | A * | 3/1995 | Valdez | 33/565 |
| 5,564,962 | A | 10/1996 | Navarrete Espinosa | |
| 5,653,621 | A | 8/1997 | Yao | |
| 5,797,784 | A | 8/1998 | Wolfe | |

(Continued)

FOREIGN PATENT DOCUMENTS

GB 2135591 A 9/1984

*Primary Examiner* — Nini Legesse

(57) ABSTRACT

What is disclosed is a versatile interlocking crossbar device and system for coupling modular components of toy assemblages, educational models, hobby constructions, component attachments, or the like together using one or more connectors, configured with a set of male connector parts and a set of female connector parts, configured to enable the selective attachment of such parts. The disclosed system is exemplified in this application as a toy vehicle and a ball and demonstrates how the parts and interlocking crossbar device interrelate to one another in a plurality of ways to create varying embodiments. The unique interrelationships spoken of are, for the most part, capable of creation because similar sized openings and recesses are indexed within each body member such that the pieces and interlocking crossbar conform thereto.

11 Claims, 9 Drawing Sheets

U.S. PATENT DOCUMENTS 5,806,853 A * 9/1998 Druckman et al. ..... 273/156
6,132,282 A * 10/2000 Camp ..... 446/124
6,276,684 B1 * 8/2001 Hershkovits et al. ..... 273/156
6,450,853 B1 * 9/2002 Larws ..... 446/93
6,595,824 B2 7/2003 Calello et al.
D480,116 S * 9/2003 Collins ..... D21/479

* cited by examiner

INTERLOCKING CROSSBAR DEVICE AND SYSTEM

BACKGROUND OF THE INVENTION

1. Field of the Invention

This invention is in the field of configured connecting systems for coupling modular components of toy assemblages, educational models, hobby constructions, component attachments, or the like. The interlocking crossbar device and system enables products such as children's toys, puzzles, balls, model vehicles, model animals, model building structures and related products to be easily transformable by interlocking different pieces and to stand on their own so that each piece is capable of being used as a transportable mobile puzzle and play item.

2. Brief Description of the Background Art

BACKGROUND OF INVENTION

In the broad fields of children's toys and puzzles, there presently exist many toys that are either pre-formed or pre-molded such as die cast vehicles, pre-cut extruded parts, and stationery puzzles while others snap together to form a predetermined model shape or a shape emanating from the child using the toy. Exemplary devices of this type are disclosed in the following U.S. Pat. Nos. 4,744,780, 5,797,784, 5,486,127, and 5,653,621.

These do help educate the child in the general development of small motor skills. Further prior art shows toy building blocks that have various sizes and shapes but interlocking means only from two opposite faces thereof which limits the possibilities of designs ultimately constructible with the blocks. The simple interlocking means of prior art toy building blocks is usually a longitudinal press fit between protrusions of an upper face of a first block and corresponding recesses of a lower face in a second block. Such an interconnection is weak, particularly when subjected to a force perpendicular to a longitudinal force used to combine the blocks. Thus, a user may experience considerable frustration when, after having spent much time constructing a model from the blocks, the model starts to disintegrate when played with as a toy. A great many of the types of block or block form sets presently available are of limited usefulness. As an example, building blocks which children use in constructive playtime are generally useful only for the limited purpose of constructing structures such as houses, castles, garages, roads and the like. There is no way of connecting and retaining the shape of the child's imaginative structure without the use of glue or snaps or pre-formed building blocks with such snap together designs. While this limited usefulness is suitable for stimulating a child's creative imagination and teaching him shapes, colors and configurations, once the child is through playing with the building blocks, he has to put them away instead of retaining their shape to use on another play occasion.

To develop higher mental faculties, it is generally accepted that puzzles develop those. Prior art shows that puzzles usually come in two forms. Knob puzzles, designed for young children generally have large pieces attached to a pre-formed handle to facilitate handling and fit into a pre-formed gently curved cut-out frame. Such pieces are often designed with graphics and are simple to place and remove so that they form adjacent portions within the frame. Jigsaw puzzles, cut from thin cardboard to form interfitting and interlocking designs are often used for older children and adults with adequate manual dexterity. The pieces interlock by pressing adjacent pieces into place. The challenge associated with puzzles is that each piece carries a portion of the overall scene or information necessary to complete the puzzle.

Both knob and jigsaw types of puzzles as well as pre-formed vehicles are stimulating toy products, but generally have the limitation of single use. A pre-formed vehicle has no other use than that for which it is made. A puzzle once put together, whether within a frame or on a tabletop, generally satisfies the child or adult user who then moves on to other stimulations. As they offer relatively little flexibility, they are not good developers of creativity. Such toys, for the most part, are not readily capable of assembly in distinctive forms that can vary according to the child's or adult's whim or desire. Prior art does address the need for a 3-dimensional puzzle and play set by forming interlocking pieces of at least ½ inch thickness so that they may stand up unsupported. The limitation on such an invention is that it doesn't stimulate outdoor as well as indoor play, the products lack mobility and transportability, and the pieces, while 3 dimensional, do not promote long duration play value which stimulates manual dexterity and creativity among children and adults.

Whether relating to pre-formed vehicles, puzzles or blocks, there is a long and unfulfilled need for a connecting system which has interlocking means provided on each face thereof and that interlocking means has a high resistance to impact yet can be simply disassembled and re-assembled when desired.

Accordingly, it is the intention of this invention to combine puzzle building skills gained from assembling, re-assembling and disassembling stationary puzzles with the skills gained from playing with blocks and with mobile transportable play objects such as vehicles containing wheels, animals and building structures, and sports themed objects such as balls. In this way, manual dexterity skills, higher mental skills and creativity may be taught and learned by children and adults.

SUMMARY OF THE INVENTION

To achieve the combination of puzzle building mental skills, manual dexterity and creative assembling skills, the disclosed explains an interlocking crossbar device and system that creates both realistic and fantasy play, both of which have strong psychological value for growing minds. This is accomplished by indexing all component parts so that they may be interrelated to one another, matched into both realistic and fantasy combinations for play value and create longer duration play value. Through use of the interlocking crossbar device and system, a new set of toys and related recreational objects can be made by producing unique ways to create modular structures of various forms. In doing so, numerous constructions may be created further increasing the versatility of the toy according to the child's or adult's imagination.

Accordingly, it is a primary object of the present invention to provide a novel and useful versatile interlocking crossbar device and system that enables modular structures to be formed such as reconfigurable toys, puzzles, mobile puzzles, model animals, building structures, construction models, instruction kits and coupling of toy assemblages, educational models, hobby constructions, or any of a number of uses for consumer and commercial products using interchangeable parts to connect components together in this fashion.

It is a further object of this invention to provide such a toy product that stimulates creativity in children and in adults.

It is a further object of this invention to enable 3-dimensional play value including but not limited to producing puzzles that move and stimulate interest in transportation and mobility.

It is a further object of this invention to provide such transportable and mobile puzzles and products that enable interlocking pieces to be held together firmly and turned horizontally, vertically and laterally without falling apart due to the interlocking cross device contained within.

It is a further object of this inventions to provide a system for interconnecting modular constructions such that a structure made with the system cannot be separated by opposite lateral forces being applied respectively thereto and has considerable resistance to potentially destructive impact, yet can easily be disassembled when required.

It is a further object of this invention to demonstrate that unlike other mortise and tenon joining systems, which are designed specifically not to come apart, the present system is designed so that the use of mortise and tenon in conjunction with the vertical or horizontal locking pin device can be used for connecting or disconnecting multiple pieces together in novel and original ways.

It is a further object of this invention to provide a plurality of building and connecting elements which can be assembled to create 3-dimensional shapes without the need of conventional fasteners or adhesives.

It is a further object of this invention to provide a plurality of building and connecting elements which may be assembled to provide a sturdy and durable container for the remaining building elements without having to disassemble it and put it away after use.

It is a further object of this invention to encourage and promote in children and adults the development of motor skills, shape differentiation skills, and problem solving skills using three dimensional play.

It is a further object of this invention to provide a product that requires less manual dexterity for a child to employ while providing a higher degree of play value, and similarly a greater degree of play value for an adult who has higher manual dexterity.

It is yet a further object of the present invention to provide a device as characterized above which is extremely simple to use thereby appealing to users having a modest skill level but also capable of manipulation by extremely creative people thereby spanning a broad spectrum in maintaining interest of users.

It is a further object of this invention to provide a product in which each separate piece of the product may be transferred to or interchanged with another product to form new creative products for single play or group play and appreciation.

It is a further object of this invention to provide a set of building and connecting elements that are so constructed as to be readily and easily assembled, disassembled and reassembled.

It is yet a further object of the present invention to provide a device as characterized above which is durable in construction, safe to use and lends itself to mass production techniques.

It is a further object of this invention to provide a set of building and connecting elements which in addition to all the above advantages will also be inexpensive to manufacture and be in compact form for shipping purposes.

It is yet a further object of the present invention to provide a device and system as characterized above which is both visually and tactilely stimulating It is yet a further object of the present invention to provide a device as characterized above which is dimensioned such that even young children can safely play with the device and components forming each embodiment.

It is yet a further object of the present invention to provide a device as characterized above where the device and modular components can be interconnected in a multiplicity of ways, thereby promulgating creativity and providing an extremely large number of possible structures buildable with them.

The disclosed interlocking crossbar device and system is exemplified in this application as a shaped ball and as a toy vehicle.

The exemplary ball is comprised of a connector system consisting of a fixed end cap module, insertable vertical post that joins between the male member and female member, a second fixed end cap module with female member and a t-shaped interlocking crossbar coupler. Inside the ball any number of fitted shaped horizontal or vertical discs containing printed or engraved content may be inserted onto the vertical post and then closed between the two fixed end caps. The locking pin coupler holds the final assemblage together.

The exemplary vehicle comprises a plurality of components and is broken down into five primary parts, namely a front module with female recessed member with mortise, a rear module with radially extending male member with tenon, two pairs of wheels attached to and connected by an axle with female recessed aperture, one horizontal t-shaped connector bar, and one vertical t-shaped locking pin. The stylistically different interchangeable vehicle body modules may be removably secured. The reconfigurable assembly is disclosed which is adapted to be reversibly transformed to provide multiple kinds of configurations entirely different from each other by attaching different modular or body parts and all connected by one or more interlocking crossbar devices. In doing this any number of hybrid vehicles may be produced. The modules incorporate an engagement means, located and spaced to make it possible to easily align, connect and disconnect the modules. The wheel constructions include a plurality of similarly sized openings thereby allowing same to be used in a variety of ways in conjunction with the axles and body members The unique interrelationships spoken of are capable of creation because similar sized openings and recesses are maintained within the body member such that the vertical and horizontal interlocking crossbar couplers lock the disclosed body parts so that the modular pieces containing the mortise and tenon conform thereto. The interrelated parts enable a plurality of ways to create varying embodiments.

These together with other advantages which will become apparent reside in the details of construction as more fully hereinafter described.

The object is achieved by including a configured area or one or more interlocking crossbar devices that insert through the body of the modular pieces. Using horizontal and vertical crossbars where needed to join and lock male modules with tenon so that it will engage a female opening with mortise in a certain selective positions wherein any rotational movement is prevented or restricted.

Another beneficial feature of this interlocking crossbar device is that the extendable locking pin can be entirely concealed within the modular components to be connected.

Another beneficial feature is that the peripheral walls whereby the modular elements can interlock with each other can reside in either a horizontal plane via the first interlocking means, a vertical plane via the second interlocking means, or both, depending upon the stability and strength required for each embodiment.

Another beneficial feature is the ability during manufacture to place the axles (5) and (6) of each modular component (3) and (4) closer to one another or farther apart from one another, such that the weight bearing capability in front or rear can sustain the addition of additional interchangeable elements that prevent the assemblage from tipping over during play. An example would be adding a toy pickup truck shaped front module to a toy fire engine shaped rear module.

In accordance with one aspect of the present invention, the first interconnecting means comprises a plurality of couplers each having an arc up to 90 degrees, extending perpendicularly and outwardly from a mediate point of the peripheral modular piece.

In accordance with another aspect of the present invention, the second interconnecting means comprises a plurality of slots inwardly defined in the peripheral wall of each modular piece.

The peripheral wall comprises at least three side walls and each side wall is straight is straight and of a length, identical to straight walls of other elements of a same size series.

In accordance with a further aspect of the present invention, the interlocking crossbar devices further comprises a second plurality of elements each sized and configured to interlock with the first plurality of modular construction elements to increase permutations of engagement therebetween.

Other objects, advantages, and novel features of the invention will become more apparent from the following detailed description when taken in accompaniment with the drawings.

DETAILED DESCRIPTION OF THE PREFERRED EMBODIMENTS OF THE INVENTION

Figure 1:
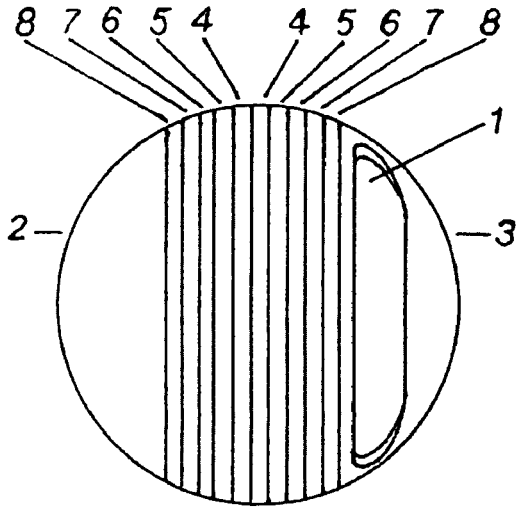
FIG. 1 is a top view showing the invention in a three dimensional shape, formed as an exemplary ball when assembled.
Figure 2:
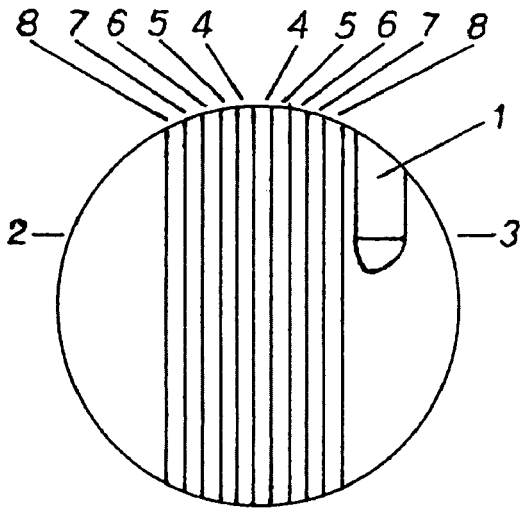
FIG. 2 is a side view of same ball.

The disclosed exemplary system demonstrates two embodiments of the invention. Referring now to the drawings, FIGS. 1-8B illustrate one embodiment of the invention in which a plurality of modular structural members are joined by the interlocking crossbar device to form a round ball. Referring now also to FIGS. 9-14 illustrate a second embodiment of the invention in which a plurality of modular structural members are joined by the interlocking crossbar device to form a toy vehicle.

Figure 4:
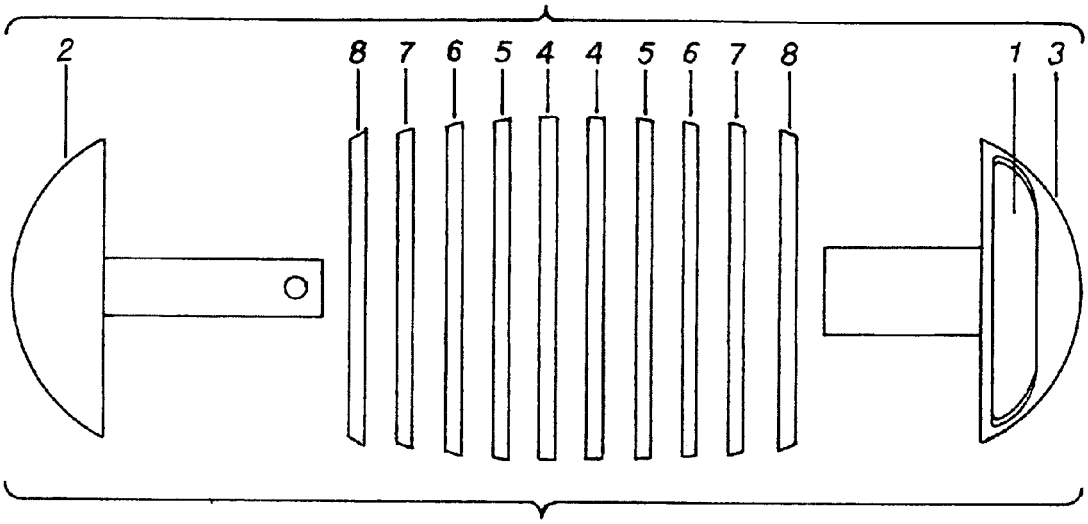
FIG. 4 is an exploded top view of the invention revealing the crossbar, item 2, as it is separated from the modules and item 3.

The first embodiment is an exemplary ball rendered in three dimensions. The ball is comprised of an interlocking connector system consisting of four primary components including a fixed shaped end cap module with a female connector or well (3), a second fixed shaped end cap module (2) into which may fit a male connector post (2) and a tshaped locking pin socket coupler (1) and any number of a series of fitted shaped beveled horizontal or vertical discs (4), (5), (6), (7) and (8), which may contain printed or engraved content, and any combination of which contain cut sockets enabling (2) and (3) to enclose them through the use of the locking pin socket coupler (1) that holds the final assemblage together. The coupling member is preferably made of wood or plastic and can be molded as a single piece or as a plurality of pieces which are subsequently bonded together. The pieces are joined together by means of a novel mortise, tenon and locking pin coupler system as shown in FIG. 4 exploded top view, FIG. 5 exploded side view and FIG. 6 exploded bottom view. The locking pin socket coupler demonstrated in FIG. 7 cross sectional view demonstrates how it joins the extendable protrusion of the insertable post attached to (2) at a ninety degree angle and locks all pieces together such that the ball may be rolled, thrown, tossed without disassembling during such action. The socket cut demonstrated in FIG. 6 on piece (2) is round but alternate socket shapes cut into the vertical or horizontal discs may be, for example, square, triangular, or star shaped and dimensioned such that one shape of projection will not fit into a different shape of socket.

Figure 7:
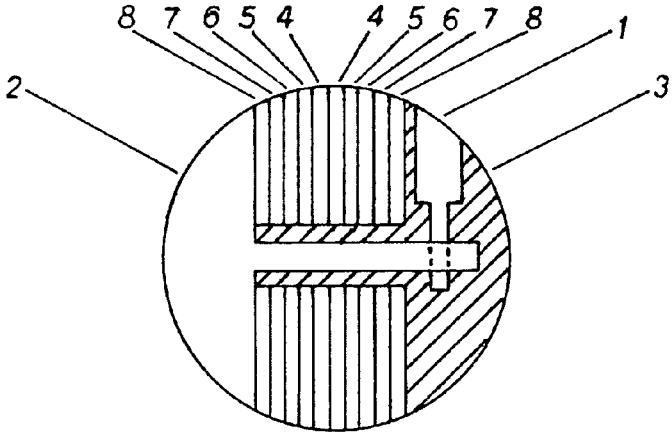
FIG. 7 is a cross sectional view through the assembled ball.

FIG. 7 shows a interlocking crossbar coupling member (1) according to the present invention installed in a rounded opening carved in the body of the modular component (3). It can be seen that the member (1) fully extends through the aperture drilled through the horizontal crossbar attached to modular member (2) sufficient to create both a ledge and a lock. When installed in such a modular component, the surface of (1) may be flush with the outer surface of the wall on (3) or it may be recessed slightly therefrom.

Figure 8A:
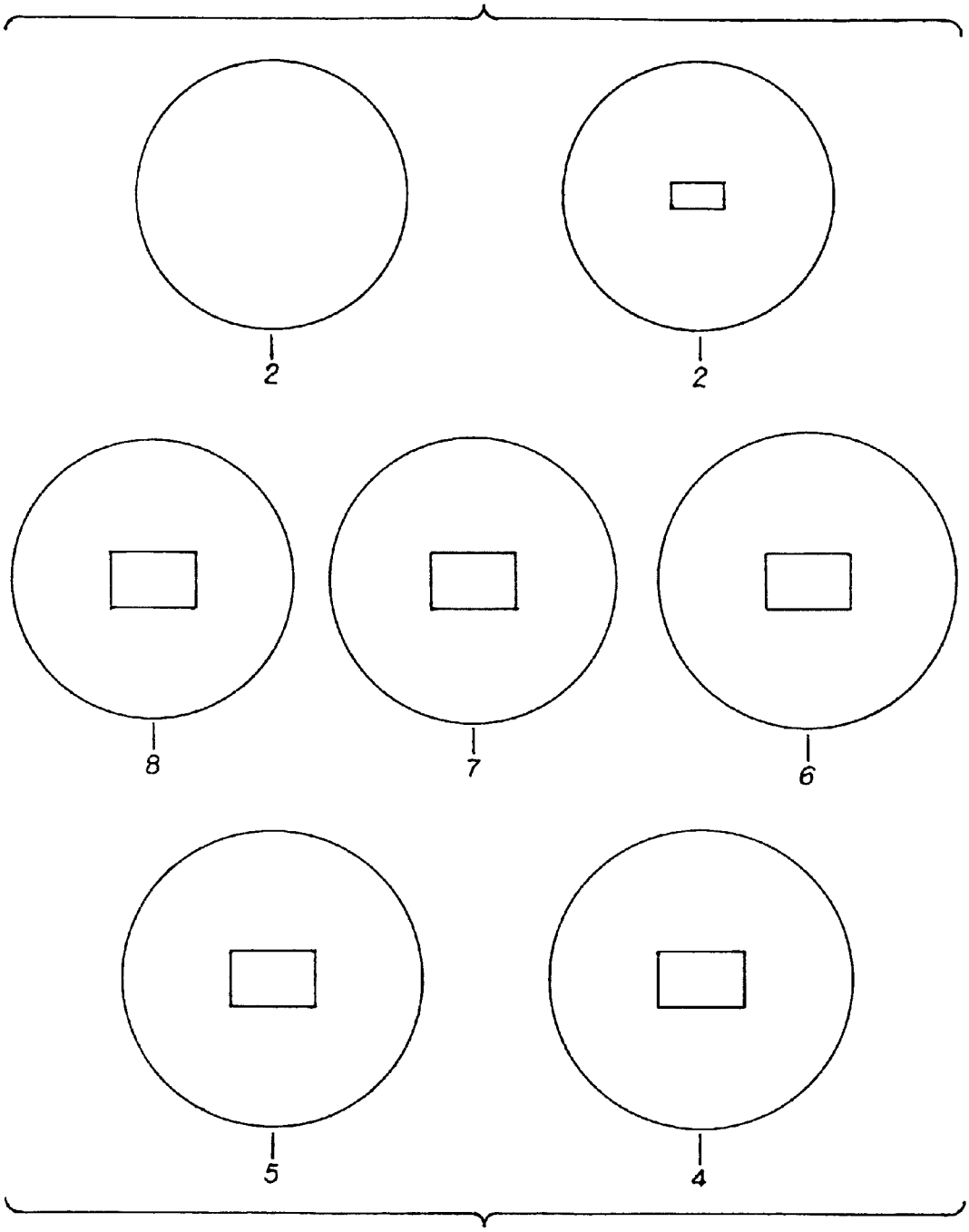
FIG. 8A is an expanded view of one side of the exemplary ball.
Figure 8B:
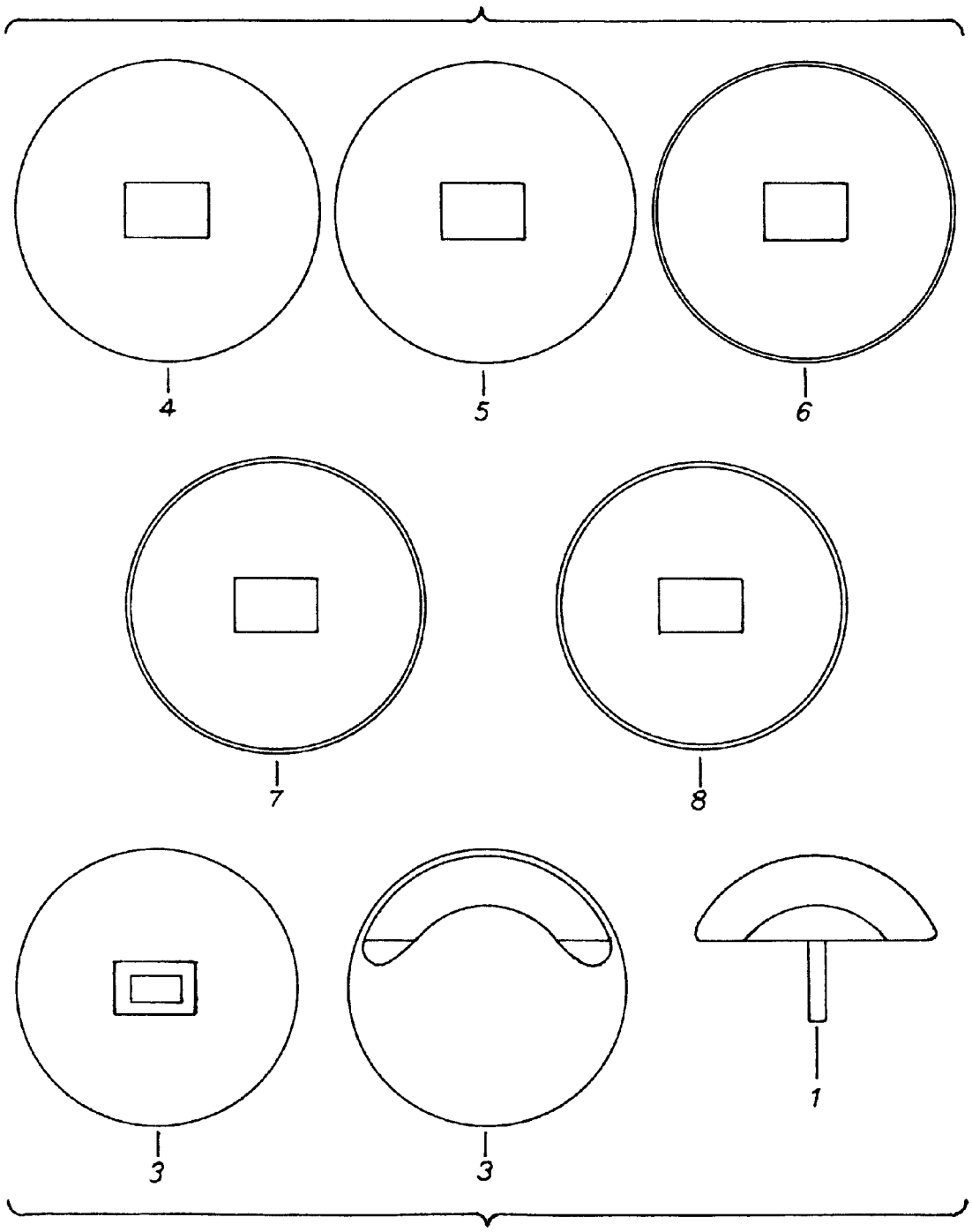
FIG. 8B is an expanded view of the opposite side of the same ball and the locking pin, item 1.

In FIG. 8A sectional view and FIG. 8B sectional view of the internal apertures cut into each of the discs that fit onto the male connector post attached to (2) by means of a cutout aperture of any fixed shape. In the exemplary version, such cutouts (4),(5),(6),(7) and (8) are square but they may be any fixed shape that allows the discs to hold their shape and position while inserted on the male connector post. The socket cuts demonstrated on the internal surface of each disc (4),(5),(6),(7) and (8) on FIG. 8A and FIG. 8B are rectangular but alternate socket shapes cut into the discs may be for example triangular or star shaped. Moreover, the outer design lines line up with the inner core construction so that in this embodiment, there is one correct way to re-assemble the ball.

It is the intent of the invention that the male connector post along with other modular pieces may be made of any material, whether wood, acrylic or plastic and will fit together when tooled according to the invention description.

The pairs of vertical discs (4),(5),(6),(7) and (8) are distinct while placed in a contoured position on each ball but as the content printed or engraved on each may vary, the completed ball allows interchangeable parts to be shared among collectors of such content. Each disc is indexed to be interchangeable with their like parts of other balls such that the twin (6) discs would fit a pair of (6) discs on an different ball of the same shape and size. By mixing and matching the internal components, and rotably assembling them to fit both internal and external dimensions, any child or adult can create a useful ball that has the added value of interchangeable information contained on such ball. As such, each ball may enable new forms of trading printed or engraved content much as sports trading cards and the like provide, but with the added value of learning how to assemble such content in unique and novel ways in the puzzle and providing the extra value of a three dimensional throwable ball or object.

FIG. 1 illustrates a top view of an exemplary ball, showing how all beveled pieces fit flush to the surface. It further demonstrates how in order to form a true ball or spherical shape, beveled and sanded cuts are shaped for two members of each connecting discs within the ball, each fitting around the internal shaft, such that as the curvature of the ball increases in angle, the pieces conform thereto. In the exemplary ball, there are two elements each of (4), (5), (6),(7) and (8). This is further illustrated in FIG. 2 in which the pieces conform to the shape of the ball and with the locking coupler pin (1). The male extendable portion of the male portion FIG. 5(1) is composed of a solid cylindrical shank attached to a rectangular or trapezoidal crossbar.

Figure 3:
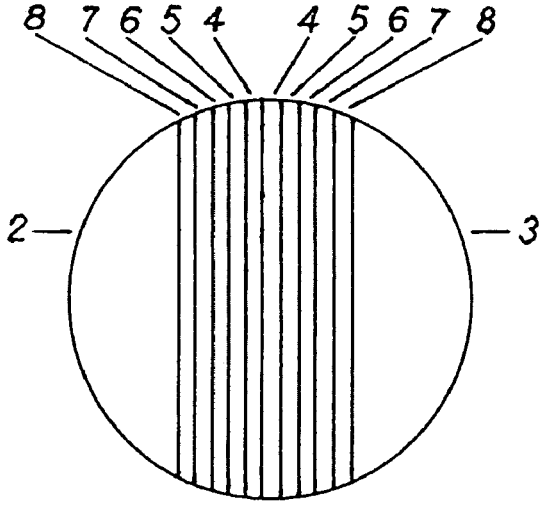
FIG. 3 is a bottom view of same ball.

This is further illustrated in FIG. 3 bottom view in which all modular elements are flush to the surface of the sphere or ball shape.

The material for the interlocking crossbar member (1) and (2) shown in FIG. 7 could be selected, in conjunction with the thickness of modular end cap components (2) and (3) to establish any desired level of connection and disconnection force.

Referring now to FIGS. 9-14, there is a second embodiment in the form of an exemplary toy wheeled vehicle. The vehicle comprises a plurality of modular components and is broken down into five primary parts shown in FIG. 13, namely a front module (3) with female recessed member mortise, a rear module with radially extending male member tenon (4), two pairs of wheels attached to and connected by an axle with female recessed cavity (5), one horizontal t-shaped coupler (2), and one vertical t-shaped locking pin coupler (1), in which the male portion FIG. 13(1) is composed of a solid cylindrical shank attached to a rectangular or trapezoidal crossbar.

These interlocking couplers may be made of wood or plastic or any other materials and can be molded or shaped as a single piece or as a plurality of pieces which are subsequently bonded together.

The stylistically different interchangeable vehicle body modules may be removably secured. The reconfigurable assembly is disclosed which is adapted to be reversibly transformed to provide multiple kinds of configurations entirely different from each other by attaching different modular or body parts. In doing this any number of hybrid vehicles may be produced. The modules incorporate an engagement means, located and spaced to make it possible to easily align, connect and disconnect the modules. The wheel constructions include a plurality of similarly sized openings thereby allowing same to be used in a variety of ways in conjunction with the axles and body members.

Figure 9:
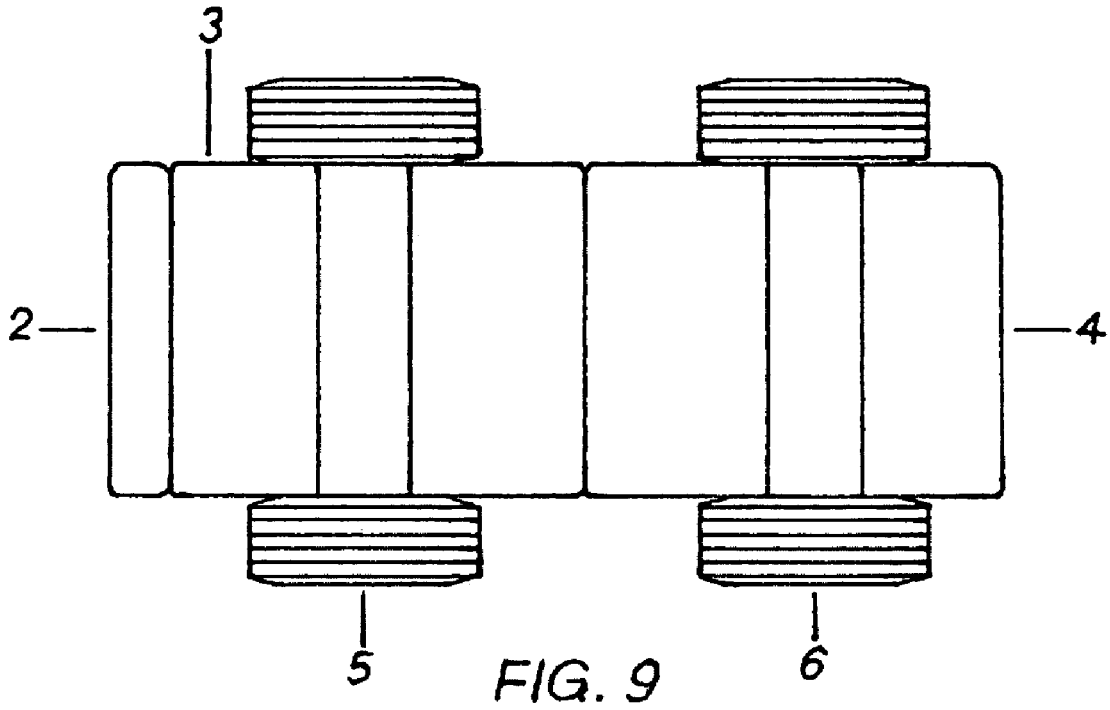
FIG. 9 is the bottom view showing the invention in its three dimensional shape, formed as an exemplary toy vehicle.

FIG. 9 illustrates in bottom view how the interlocking horizontal t-shaped crossbar coupler device (2) extends through the entire modular assembly to enable a series of modular puzzle pieces to form an interconnected vehicle that can be rolled and played with without any other pieces disassembling other than by choice of the user.

Figure 10:
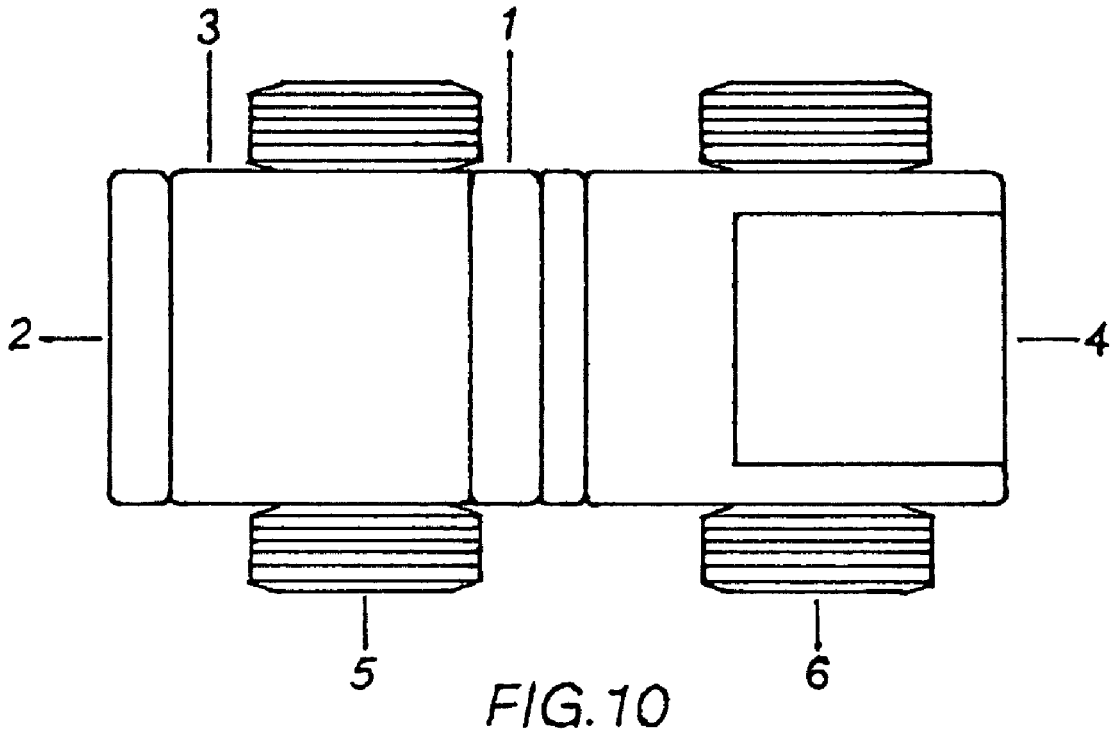
FIG. 10 is the top view of same toy vehicle.

FIG. 10 illustrates in top view how the interlocking vertical t-shaped crossbar locking pin coupler (1) holds extends downward through the modular assembly to enable a series of modular puzzle pieces to form an interconnected vehicle that can be rolled and played with without any other pieces disassembling other than by the choice of the user.

Figure 11:
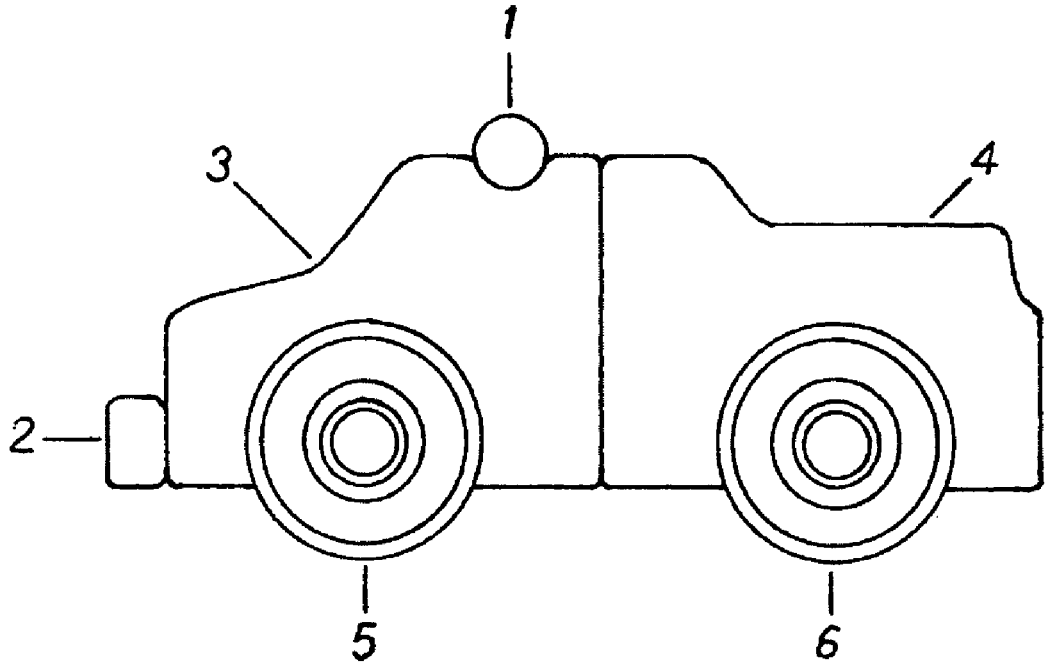
FIG. 11 is a transparent side view of the assembled toy vehicle.

FIG. 11 illustrates in side view how the interlocking crossbar devices (2) and (1) enable the vehicle to hold its shape of the internally connected mortise and tenon puzzle pieces without any other pieces disassembling other than by the choice of the user. It shows how a interlocking crossbar coupling member (1) according to the present invention installed in a rounded opening carved in the body of the modular component (3). It can be seen that the member (1) fully extends through the aperture drilled through the horizontal crossbar attached to modular member (2) sufficient to create both a ledge and a lock. When installed in such a modular component, the surface of (1) may be flush with the outer surface of the wall on (3) or it may be recessed slightly therefrom.

Figure 12:
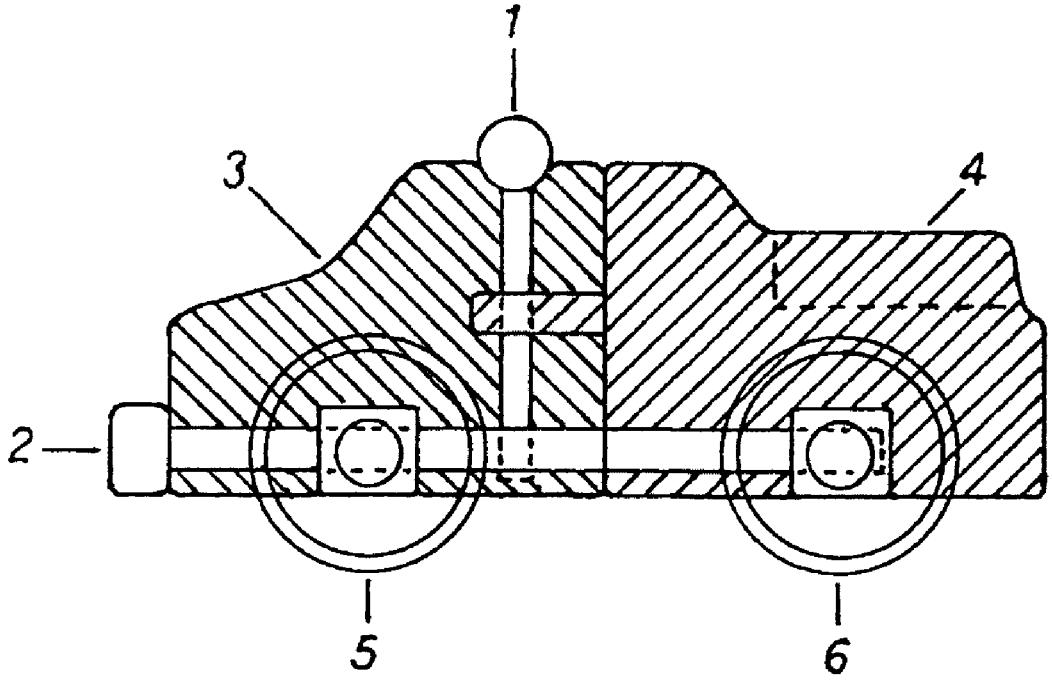
FIG. 12 is a cross sectional side view showing the locking pin, item 1, internally intersecting mortise, tenon, and crossbar, item 2, to form an assembled and locked toy vehicle.

FIG. 12 further illustrates in cross sectional view how the front module with mortise (3) fits into the rear module with tenon (4) and how both mortise and tenon are doubly connected by the novel insertion of the vertical interlocking crossbar (1) through the tenon joint and again through the aperture cut in the horizontal interlocking crossbar that extends through the front module (3), the rear module (4) and the two axles containing wheels (5) and (6). FIG. 12 also demonstrates how the horizontal interlocking crossbar device (2) is comprised of a head and shaft that fits against the wall of the modular surface (3) and contains a drilled aperture along its shaft such that the vertical locking pin coupler (1) may be inserted into it after all modular pieces are assembled.

FIG. 12 demonstrate from a cross sectional perspective how the fitted planar surface must be of identical shape and size where the vertical interlocking crossbar (1) and horizontal interlocking crossbar (2) inter-engages through the space where the module with tenon (4) joins with the module with mortise (3).

The modular components and one or more interlocking crossbar devices are matingly configured so that the final assembly is stable and secure and may be rolled, lifted, shaken, inverted, turned upside down or at a ninety degree angle without any displacement and without any of the play pieces falling out or losing shape.

The material for the interlocking crossbar member (1) and (2) could be selected, in conjunction with the thickness of modular components (3) and (4) to establish any desired level of connection and disconnection force.

Figure 13:
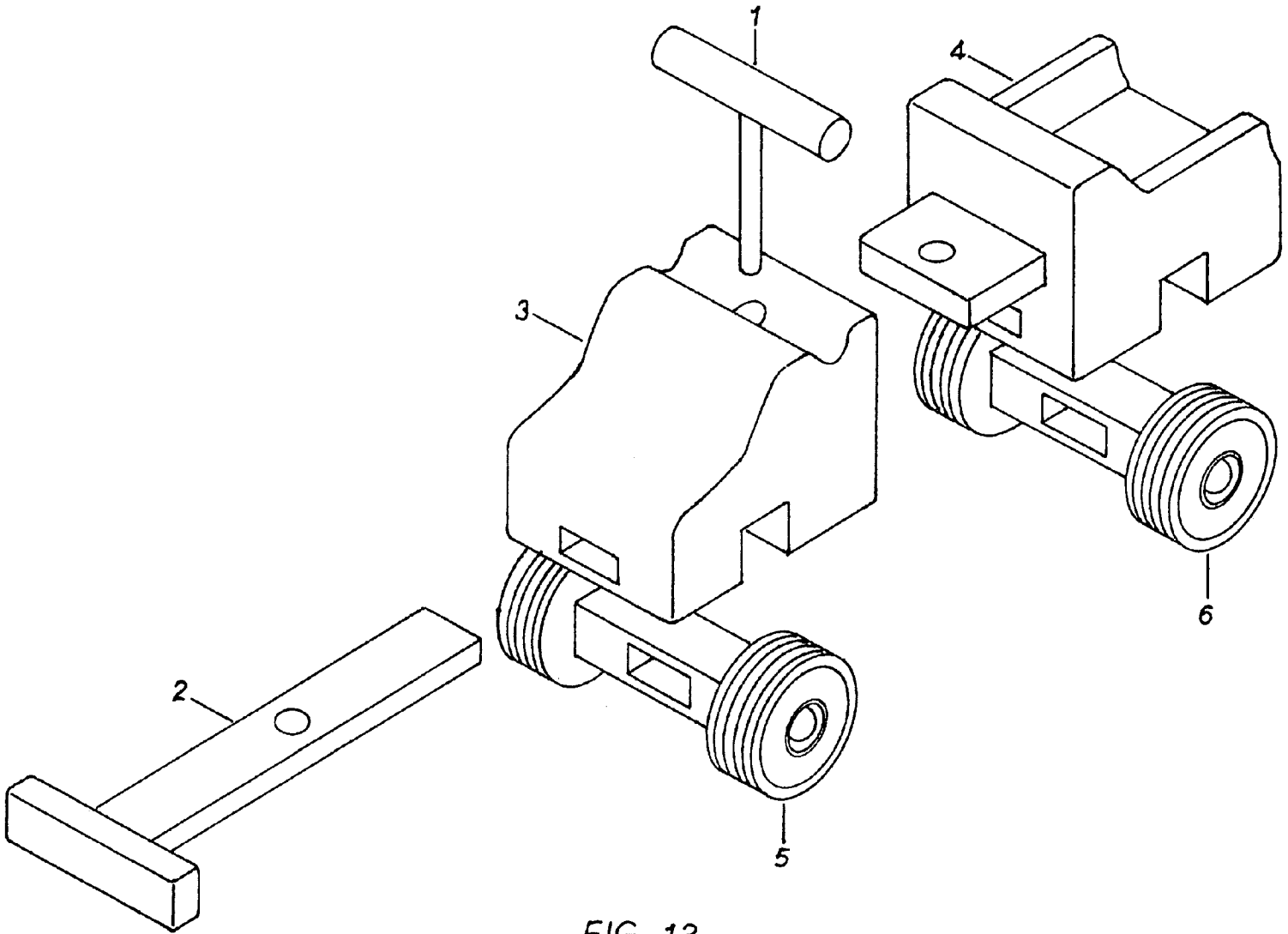
FIG. 13 is an exploded frontal transparent view of an unassembled toy vehicle.

FIG. 13 illustrates an exploded perspective anterior view of the vehicle demonstrating how the combination of a modular component with mortise (3) and modular component with tenon (4), joined by the combination of 2 interlocking crossbar devices of vertical (1) and horizontal (2) construction, may create a system of stable, sturdy play vehicles of any size, shape, and will allow interchangeable parts and shapes to be used on (3), (4), (5) and (6) to make realistic, imaginary and fantasy constructions for additional hours of learning and play value among children and adults.

Figure 14:
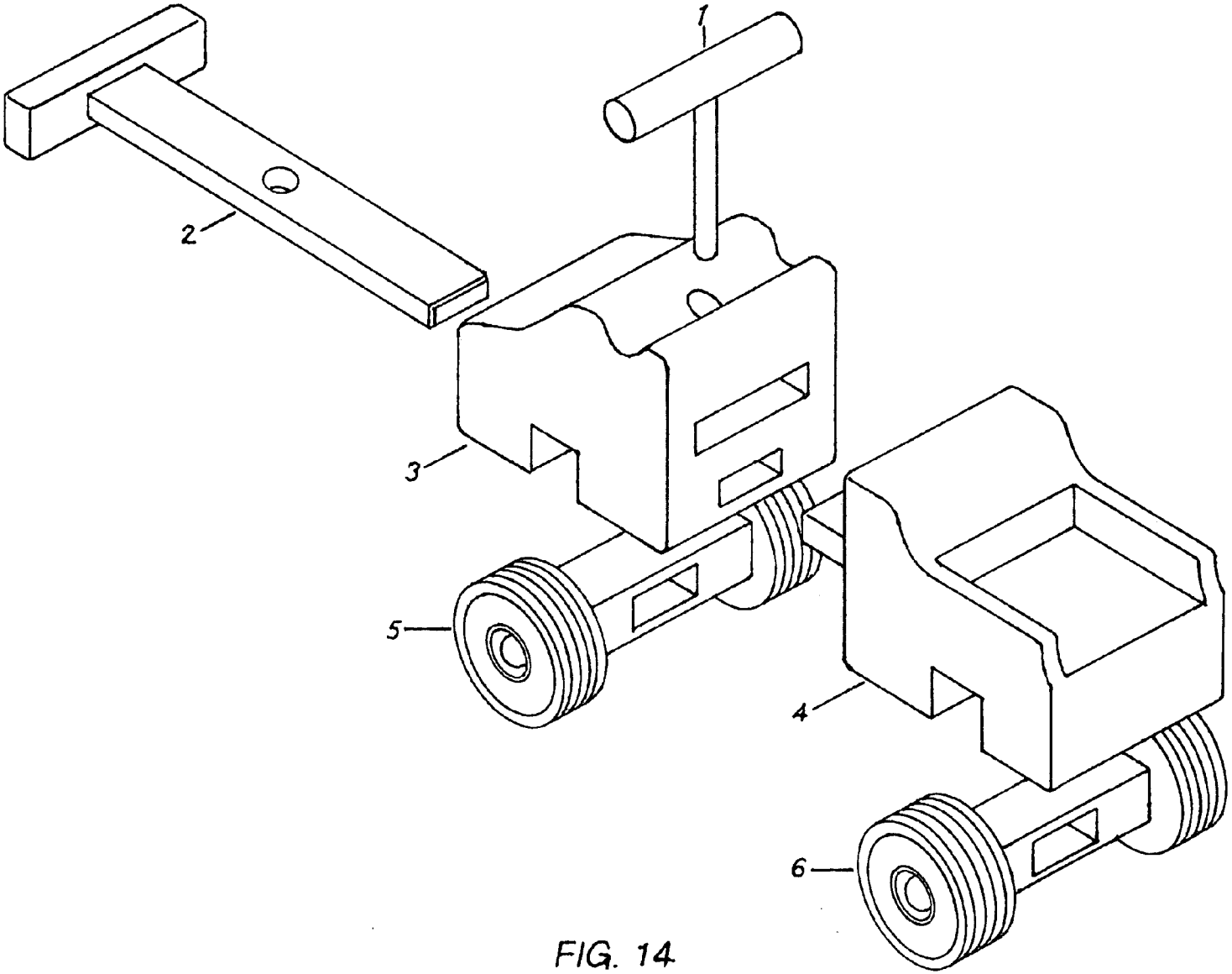
FIG. 14 is an exploded rear transparent view of an unassembled toy vehicle.

FIG. 14 illustrates an exploded posterior view of the vehicle demonstrating how the combination of a modular component with mortise (3) and modular component with tenon (4), joined by the combination of 2 interlocking crossbar devices of vertical (1) and horizontal (2) construction, may create a system of stable, sturdy play vehicles of any size, shape, and will allow interchangeable parts and shapes to be used on (3), (4), (5) and (6) to make realistic, imaginary and fantasy constructions for additional hours of learning and play value among children and adults.

Figure 5:
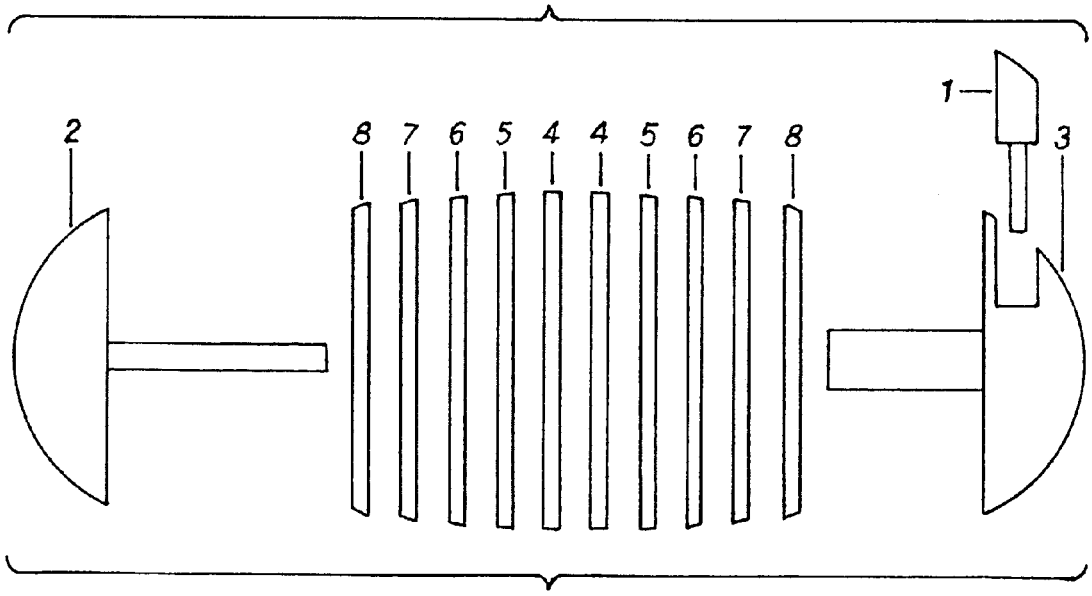
FIG. 5 is an exploded side view of the invention revealing the crossbar, item 2, and locking pin, item 1, as it is separated from the modules and item 3.
Figure 6:
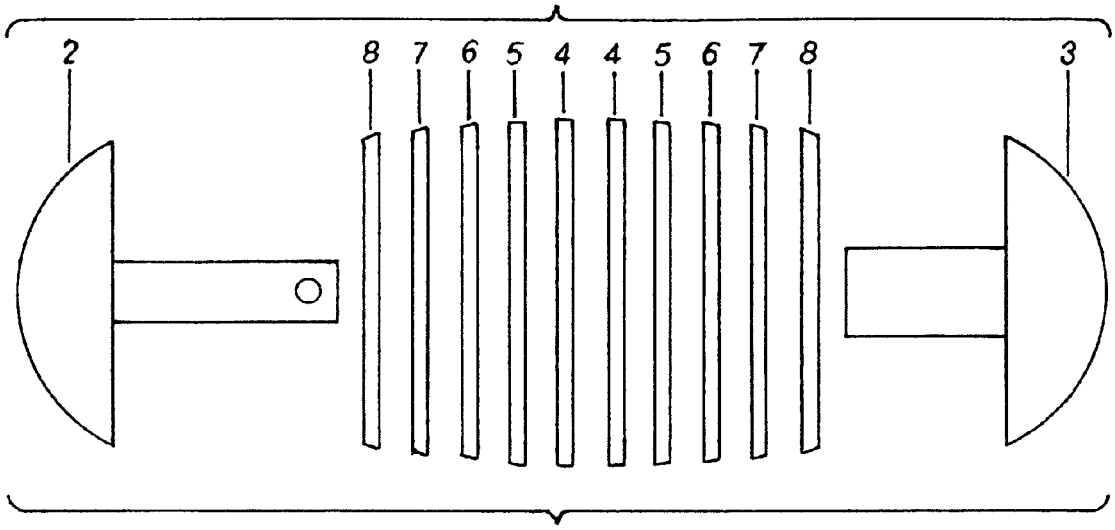
FIG. 6 is an exploded bottom view of the invention revealing the crossbar, item 2, as it is separated from the modules and item 3.

Each male portion FIG. 5(1) and FIG. 13(1) is composed of a solid cylindrical shank attached to a rectangular or trapezoidal crossbar.

The building elements of this invention are constructed of any suitable material from which toy and other puzzle assemblages may be fabricated, such as, for example, a softwood such as basswood, a hardwood such as maple, beech or cherry; or any suitable plastic or thermoplastic material, alone or in combination with one another.

While the description of the above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all aspects as illustrative and not restrictive, the scope of the invention being indicated by the appended claims rather than the foregoing description, and all changes which come within the meaning and range of equivalency of the claims are therefore intended to be embraced therein.

What is claimed is:

1. A versatile interlocking crossbar device and interlocking system comprising mortise and tenon type assembly used to connect and join one or more interchangeable modules or interchangeable components by internally intersecting at any measured point along the length of the crossbar with a locking pin; such crossbar(s) are inserted into pre-formed mortise or slots in each interchangeable indexed module to join and stabilize each module or component until the lock pin can be inserted to internally intersect the crossbar, thereby locking the unit together; such locking pin is held in place either by gravity or a close tolerance friction fit that secures each of the modules or components together, creating various assemblages including toys and puzzles that retain their shape in 3 dimensional free-standing and mobile form; and wherein the modular pieces fit together and one or more interlocking crossbar devices connect the puzzle or the toy assemblage to allow a finished device to be played with and picked up while still retaining its free-standing three-dimensional shape.

2. A system of claim 1 using one or more connectors, including but not limited to T-shaped connectors, with a set of male connector parts and a set of female connector parts, that intersect internally within the components creating a hidden and internal locking device.

3. A system of claim 1 in which one or more interlocking crossbar devices holds together one or more modular pieces in order to form a 3-dimensional, interior and hidden space where the crossbar devices intersect.

4. A system of claim 1 in which the components are combined first incorporating the mortise and tenon and/or through mortise and tenon type assembly, with allowances for crossbar and lock pin to be inserted and internallyintersect to lock and secure the components until lock pin and crossbar are removed allowing components to be disassembled or interchanged.

5. A system of claim 1 in which close tolerances must be adhered to during production to enable sufficient friction for the hidden internal intersecting locking devices to hold securely after assembly of each device and assembly.

6. A system of claim 1 in which any wood species, composite wood, acrylic, cardboard, plastic or thermoplastic may be used in combination with other modular pieces to create the interlocking crossbar device and its system components.

7. A system of claim 1 requiring that discs modules have progressing or regressing curvature or angle sufficient to create any shape or form enabling the interlocking crossbar and lock pin to secure and hold all pieces into a three dimensional and mobile device.

8. A system of manufacture of claim 1 in which discs must be center cut to sufficiently fit the card aligning post with mortise.

9. A system of claim 1 in which the mortis and tenon shapes used to interconnect with the lock pin system can be formed in any shape, including but not limited to square, round, rectangular or triangular.

10. A system of claim 1 in which interlocking crossbar devices may be comprised of T-shaped connectors and other connectors including but not limited to screw on end caps, twist locks, magnets, snap-on locks, forked locks, slide locks or channel locks.

11. A system of claim 1 in which all modular parts made are indexed so that they are interchangeable.

* * * * *